US007154447B2

(12) United States Patent
Copeland et al.

(10) Patent No.: US 7,154,447 B2
(45) Date of Patent: Dec. 26, 2006

(54) NANOCRYSTALLINE CORE ANTENNA FOR EAS AND RFID APPLICATIONS

(75) Inventors: Richard L. Copeland, Boynton Beach, FL (US); Eddie H. Keith, Lantana, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 158 days.

(21) Appl. No.: 10/745,128

(22) Filed: Dec. 22, 2003

(65) Prior Publication Data

US 2005/0134515 A1 Jun. 23, 2005

(51) Int. Cl.
*H01Q 7/08* (2006.01)

(52) U.S. Cl. ..... 343/788

(58) Field of Classification Search ..... 343/856, 343/857, 863, 867, 868, 866, 787, 788
See application file for complete search history.

(56) References Cited

U.S. PATENT DOCUMENTS

| | | | | |
|---|---|---|---|---|
| 5,220,339 | A * | 6/1993 | Matsushita | 343/788 |
| 5,567,537 | A * | 10/1996 | Yoshizawa et al. | 428/800 |
| 6,121,879 | A | 9/2000 | Lian et al. | 340/572.3 |
| 6,232,879 | B1 | 5/2001 | Tyren | 340/572.6 |
| 6,417,771 | B1 | 7/2002 | Tyren | 340/572.2 |
| 6,840,440 | B1 * | 1/2005 | Uozumi et al. | 235/375 |
| 6,960,912 | B1 * | 11/2005 | Beichler et al. | 324/247 |
| 2002/0033777 | A1 * | 3/2002 | Maruyama et al. | 343/713 |
| 2003/0117282 | A1 | 6/2003 | Balach et al. | |
| 2003/0184489 | A1 * | 10/2003 | Maruyama et al. | 343/788 |
| 2004/0090868 | A1 * | 5/2004 | Endo et al. | 368/10 |

* cited by examiner

*Primary Examiner*—Shih-Chao Chen
*Assistant Examiner*—Minh Dieu A
(74) *Attorney, Agent, or Firm*—Alan M. Weisberg; Christopher & Weisberg, P.A.

(57) ABSTRACT

A nanocrystalline core antenna for use in electronic article surveillance (EAS) and radio frequency identification (RFID) systems. The nanocrystalline antenna is constructed from nanocrystalline material and exhibits improved detection range in EAS and RFID systems compared to conventional antenna configurations.

57 Claims, 10 Drawing Sheets

NANOCRYSTALLINE CORE ANTENNA FOR EAS AND RFID APPLICATIONS

FIELD OF THE INVENTION

The present invention relates to core antennas, and, in particular, to core antennas for electronic article surveillance (EAS) and radio frequency identification (RFID) systems.

BACKGROUND

EAS and RFID systems are typically utilized to protect and/or track assets. In an EAS system, an interrogation zone may be established at the perimeter, e.g. at an exit area, of a protected area such as a retail store. The interrogation zone is established by an antenna or antennas positioned adjacent to the interrogation zone.

EAS markers are attached to each asset to be protected. When an article is properly purchased or otherwise authorized for removal from the protected area, the EAS marker is either removed or deactivated. If the marker is not removed or deactivated and moved into the interrogation zone, the electromagnetic field established by the antenna(s) causes a response from the EAS marker. An antenna acting as a receiver detects the EAS marker's response indicating an active marker is in the interrogation zone. An associated controller provides an indication of this condition, e.g., an audio alarm, such that appropriate action can be taken to prevent unauthorized removal of the item to which the marker is affixed from the protected area.

An RFID system utilizes an RFID marker to track articles for various purposes such as inventory. The RFID marker stores data associated with the article. An RFID reader may scan for RFID markers by transmitting an interrogation signal at a known frequency. RFID markers may respond to the interrogation signal with a response signal containing, for example, data associated with the article or an RFID marker ID. The RFID reader detects the response signal and decodes the data or the RFID tag ID. The RFID reader may be a handheld reader, or a fixed reader by which items carrying an RFID marker pass. A fixed reader may be configured as an antenna located in a pedestal similar to an EAS system.

Historically, transmitting, receiving, or transceiver antennas in EAS and RFID systems have been configured as loop-type antennas. Recently, however, magnetic core antenna configurations have been explored for use in such systems. Materials utilized as the core material in core antennas have included ferrite and amorphous magnetic material.

Ferrite material may be provided as a powder, which is blended and compressed into a particular shape and then sintered in a very high temperature oven. The compound becomes a fully crystalline structure after sintering. Ferrite materials have a higher magnetic permeability than air, and have a relatively low saturation flux density compared, for example, to most amorphous materials. Also, ferrite materials that operate at higher RF (e.g. 15 MHz) frequencies have relatively low permeability and/or saturation flux density.

In contrast to ferrite materials, amorphous magnetic materials lack a distinct crystalline structure. Amorphous magnetic materials e.g., VC6025F available from Vacuumschmelze GmbH Co. (D-6450 Hanua, Germany), have been successfully utilized in lower frequency EAS applications, e.g., 58 kHz. However, such amorphous magnetic materials do not perform well in the RF frequency range as core loss and permeability decrease performance for frequencies higher than a few 100 kHz.

Accordingly, there is a need for a core antenna for EAS and RFID applications capable of suitable operation frequencies up to the RF range. In addition, there is a need for improved performance of a core antenna in the lower frequency range for EAS as an alternative to ferrite or amorphous materials.

SUMMARY OF THE INVENTION

An antenna consistent with the invention for use in an EAS or RFID includes: a core including a nanocrystalline magnetic material, and a coil winding disposed around at least a portion of the core. The antenna may be implemented in an EAS or RFID system for generating an electromagnetic field to interrogate a marker by providing a controller configured to provide an excitation signal to excite the antenna for operation at a given frequency.

A method of establishing extended detection range in an EAS or RFID system consistent with the invention includes: providing a nanocrystalline core antenna including a core and at least one coil winding disposed around at least a portion of the core, the core including nanocrystalline magnetic material; and exciting the antenna for operation up to and including RF frequency.

BRIEF DESCRIPTION OF THE DRAWINGS

For a better understanding of the present invention, together with other objects, features and advantages, reference should be made to the following detailed description which should be read in conjunction with the following figures wherein like numerals represent like parts.

DETAILED DESCRIPTION

For simplicity and ease of explanation, the present invention will be described herein in connection with various exemplary embodiments thereof associated with EAS systems. A core antenna consistent with the present invention may, however, be used in connection with an RFID system. It is to be understood, therefore, that the embodiments described herein are presented by way of illustration, not of limitation.

Figure 1:
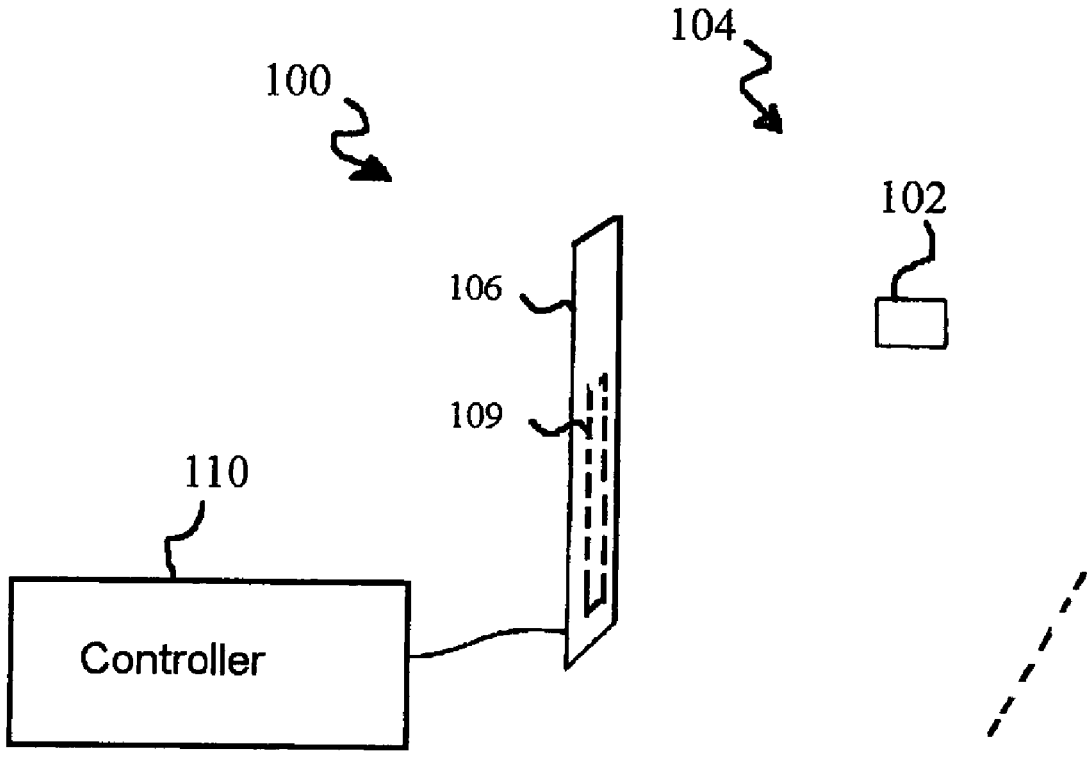
FIG. 1 is block diagram of an exemplary EAS system consistent with the invention.

Turning to FIG. 1, there is illustrated an EAS system 100 including a nanocrystalline core antenna 109 consistent with the invention. The EAS system 100 generally includes a controller 110 and a pedestal 106 for housing the core antenna 109. The controller 110 is shown separate from the pedestal 106 for clarity but may be included in the pedestal housing. In the exemplary embodiment of FIG. 1, the antenna 109 is configured as a transceiver and the associated controller 110 includes proper control and switching to switch from transmitting to receiving functions at predetermined time intervals. Those skilled in the art will recognize that there may be a separate transmitting antenna and receiving antenna located on separate sides of the interrogation zone 104.

An EAS marker 102 is placed, e.g. at a manufacturing facility or retail establishment, on each item or asset to be protected. If the marker is not removed or deactivated prior to entering an interrogation zone 104, the electromagnetic field established by the antenna will cause a response from the EAS marker 102. The core antenna 109 acting as a receiver will receive this response, and the controller 110 will detect the EAS marker response indicating that the marker is in the interrogation zone 104.

Figure 2:
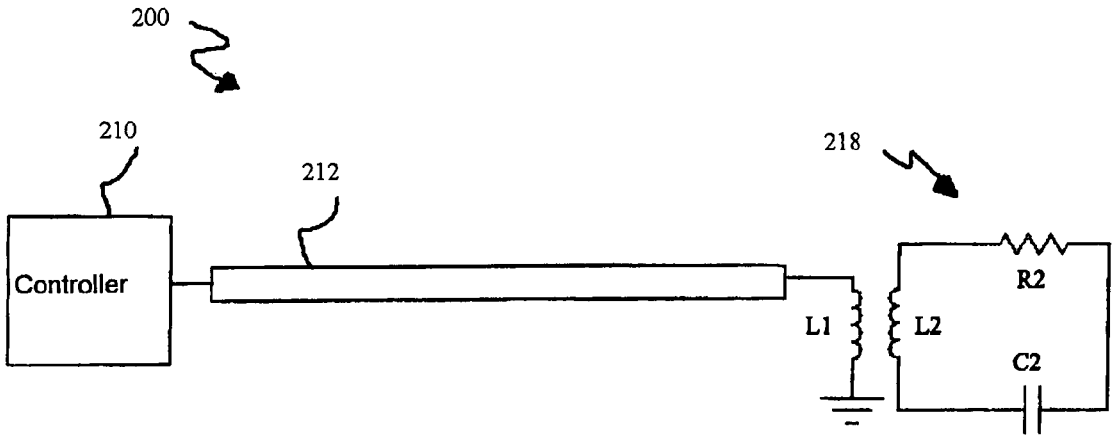
FIG. 2 is a block diagram of one embodiment of a nanocrystalline magnetic core antenna consistent with the invention.

Turning to FIG. 2, a block diagram 200 of one embodiment of a nanocrystalline magnetic core antenna consistent with the invention configured as a transceiver antenna is illustrated. In the illustrated embodiment 200, a winding is placed around the nanocrystalline magnetic core and coupled to a series resonating capacitor C2. The core antenna with this winding is represented by the inductor L2, the resistor R2, and the series resonating capacitor C2 in the series RLC circuit 218. As is known to those skilled in the art, the value of the series resonating capacitor C2 is selected to resonate or tune the antenna circuit at the desired operating frequency. Another winding, represented by L1, may be placed around the core antenna and then coupled to the transmission line or cable (depending on the operating frequency) 212, which is in turn coupled to a controller 210 having appropriate excitation and detection circuitry to support both transmit and receive functions. The winding L1 is inductively coupled to the series resonating RLC circuit 218.

The controller 210 may be adapted to operate using pulsed or continuous waveform detection schemes, including swept frequency, frequency hopping, frequency shift keying, amplitude modulation, frequency modulation, and the like depending on the specific design of the system. For instance, the controller 210 may provide a limited duration pulse at a given operating frequency, e.g., 8.2 MHz, to the transmission line cable 212 during transmission. The pulse is transmitted via the transmission line cable 212 to the core antenna load. The transmission line cable may have an impedance, e.g., 50 ohms, that matches the signal generator impedance to prevent reflections. At lower frequencies, e.g. 58 kHz, the transmission line or cable is not important in impedance matching. In addition, the impedance transformer L1 may match the resonant core load impedance of the series RLC circuit 218 to the transmission cable 212.

Figure 3:
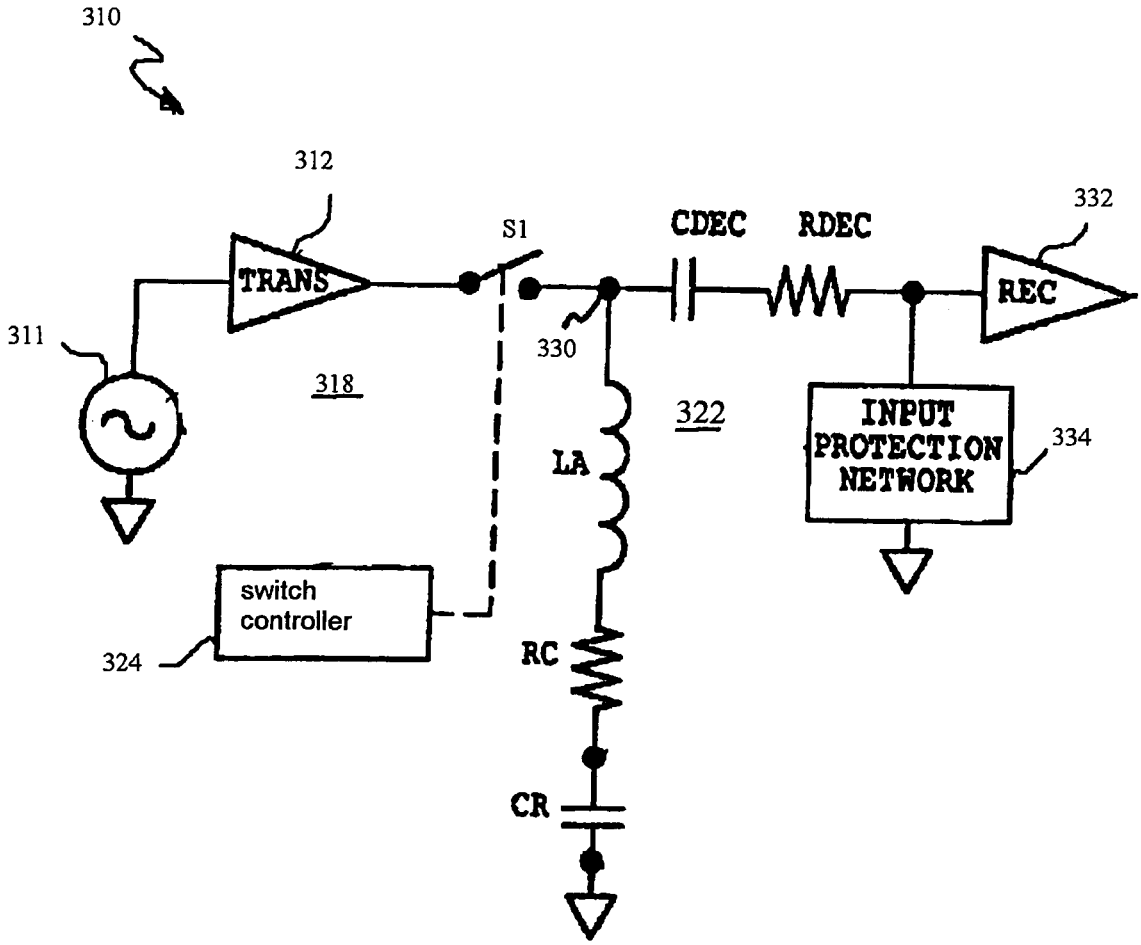
FIG. 3 is one exemplary circuit diagram of a controller for use with the system of FIG. 1.

FIG. 3 is a more detailed block diagram of an exemplary controller 310 configured for operation using a pulse detection scheme. The controller 310 may include a transmitter drive circuit 318, which includes signal generator 311 and transmitter amplifier 312. The signal generator 311 supplies an input signal to the transmitter 312 at a desired frequency such as RF frequency levels. The term "RF" as used herein refers to a range of frequencies between 9 KHz and 300 MHz.

The transmitter 312 drives the nanocrystalline magnetic core antenna represented by inductor LA, resistor RC, and resonating capacitor CR. The transmitter drive circuit 318 thus provides a burst to the core antenna at a given frequency for a short period of time to produce a sufficient electromagnetic field at a sufficient distance from the core antenna in an associated interrogation zone. A marker in the interrogation zone excited by this electromagnetic field produces a sufficient response signal for detection when the core antenna is connected to the receiver circuit portion of the controller 310.

After a short delay following the transmission burst, the nanocrystalline magnetic core antenna is coupled to the receiver circuit 322 when the switch controller 324 instructs the switch S1 to open. The switch controller 324 effectively switches the core antenna into and out of transmit and receive modes. During the transmitter pulse, the receiver circuit 322 is isolated from the antenna load at node 330 through the decoupling network formed by capacitor CDEC and resistor RDEC and the input protection circuit 334. After the transmission pulse, there is sufficient delay to allow the energy from the transmitter circuit 318 to fully dissipate. The switch controller 324 then disconnects the transmitter amplifier 312 from the antenna by opening switch S1. The alternating transmit and receive modes continue in such a pulse mode.

Figure 4:
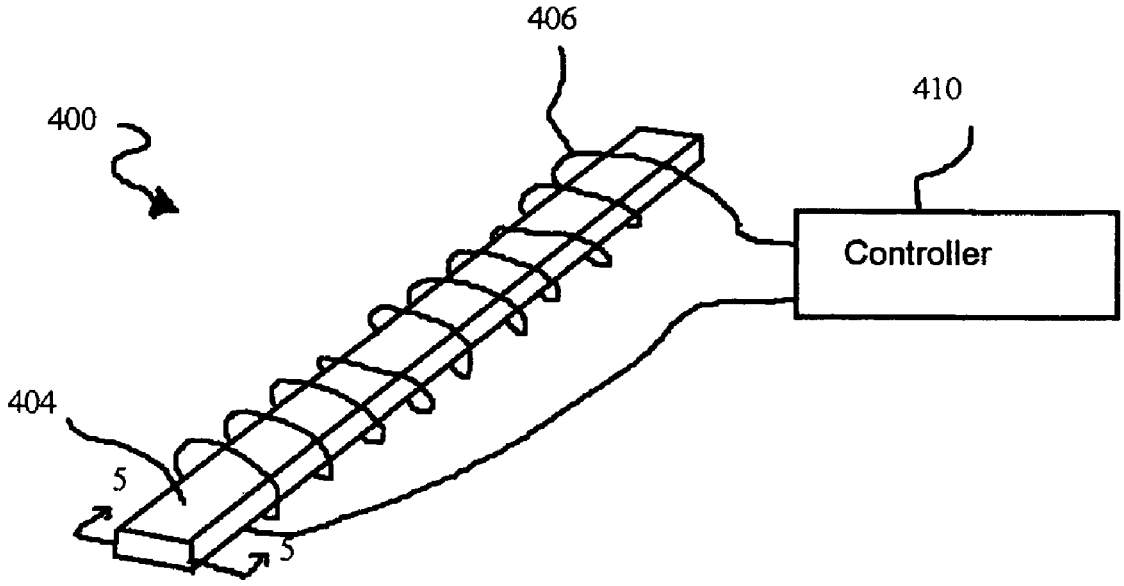
FIG. 4 is a perspective view of an exemplary nanocrystalline core antenna consistent with the invention.

A perspective view of a nanocrystalline magnetic core antenna 400 consistent with the invention is illustrated in FIG. 4. The core antenna 400 may be utilized as the transceiver antenna of the system of FIGS. 1 and 2, a transmitter antenna, or a receiver antenna. The nanocrystalline magnetic core antenna 400 includes a core assembly 404 with a coil winding 406 thereon. The coil winding 406 may be coupled to a transmission line and controller as previously detailed. Those skilled in the art will recognize that the dimension of a core antenna consistent with the invention may vary depending on application and performance requirements. In exemplary embodiments, the core may have a length in a range from 20 to 80 cm, and may have a cross-sectional area from 0.02 to 1 $cm^2$.

Figure 5:
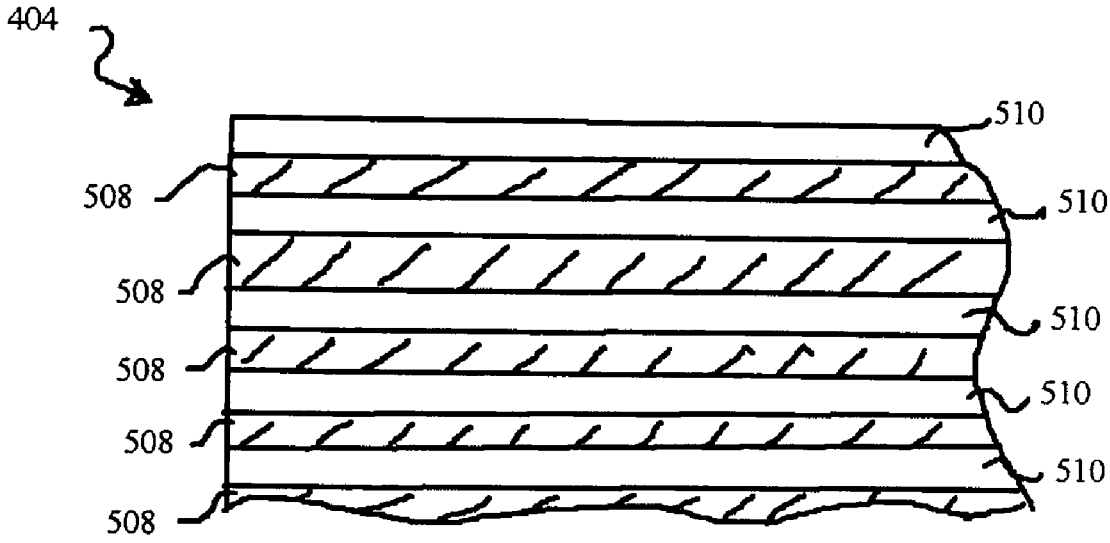
FIG. 5 is a partial cross-sectional view of the nanocrystalline core of FIG. 4 showing the insulated laminations and taken along the line 5—5 of FIG. 4.

FIG. 5 is a partial cross sectional view of the core assembly 404 taken along the line 5—5 of FIG. 4. In the illustrated exemplary embodiment, the core assembly 404 generally includes stacked ribbons 508 of nanocrystalline material laminated together with a suitable insulation coating 510. The insulation coating 510 electrically isolates each ribbon 508 from adjacent ribbons to reduce eddy current losses.

As will be recognized by those skilled in the art, nanocrystalline material begins in an amorphous state achieved through rapid solidification techniques. After casting, while the material is still very ductile, a suitable coating such as $SiO_2$ may be applied to the material. This coating remains effective after annealing and prevents eddy currents in the laminate core. The material may be cut to a desired shape and bulk annealed to form the nanocrystalline state. The resulting nanocrystalline material exhibits excellent high frequency behavior, and is characterized by constituent grain sizes in the nanometer range. The term "nanocrystalline material" as used herein refers to material including grains having a maximum dimension less than or equal to 40 nm. Some materials have a maximum dimension in a range from about 10 nm to 40 nm.

Exemplary nanocrystalline materials useful in a nanocrystalline core antenna consistent with the invention include alloys such as FeCuNbSiB, FeZrNbCu, and FeCoZrBCu. These alloys are commercially available under the names FINEMET, NANOPERM, and HITPERM, respectively. The insulation material 510 may be any suitable material that can withstand the annealing conditions, since it is preferable to coat the material before annealing. Epoxy may be used for bonding the lamination stack after the material is annealed. This also provides mechanical rigidity to the core assembly, thus preventing mechanical deformation or fracture. Alternatively, the nanocrystalline stack may be placed in a rigid plastic housing.

Figure 6A:
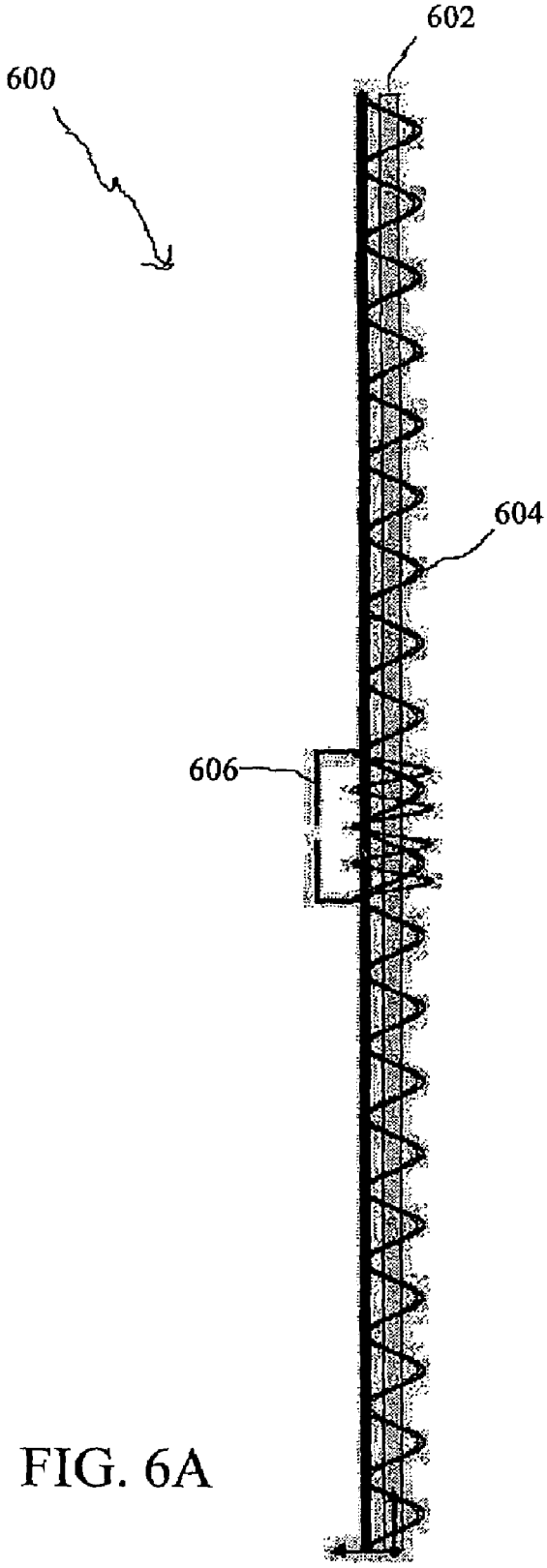
FIG. 6A is a perspective view of another exemplary nanocrystalline core antenna consistent with the invention illustrating a resonant primary coil winding and a non-resonant secondary coil winding for transmitter, receiver, or transceiver mode operation.
Figure 6B:
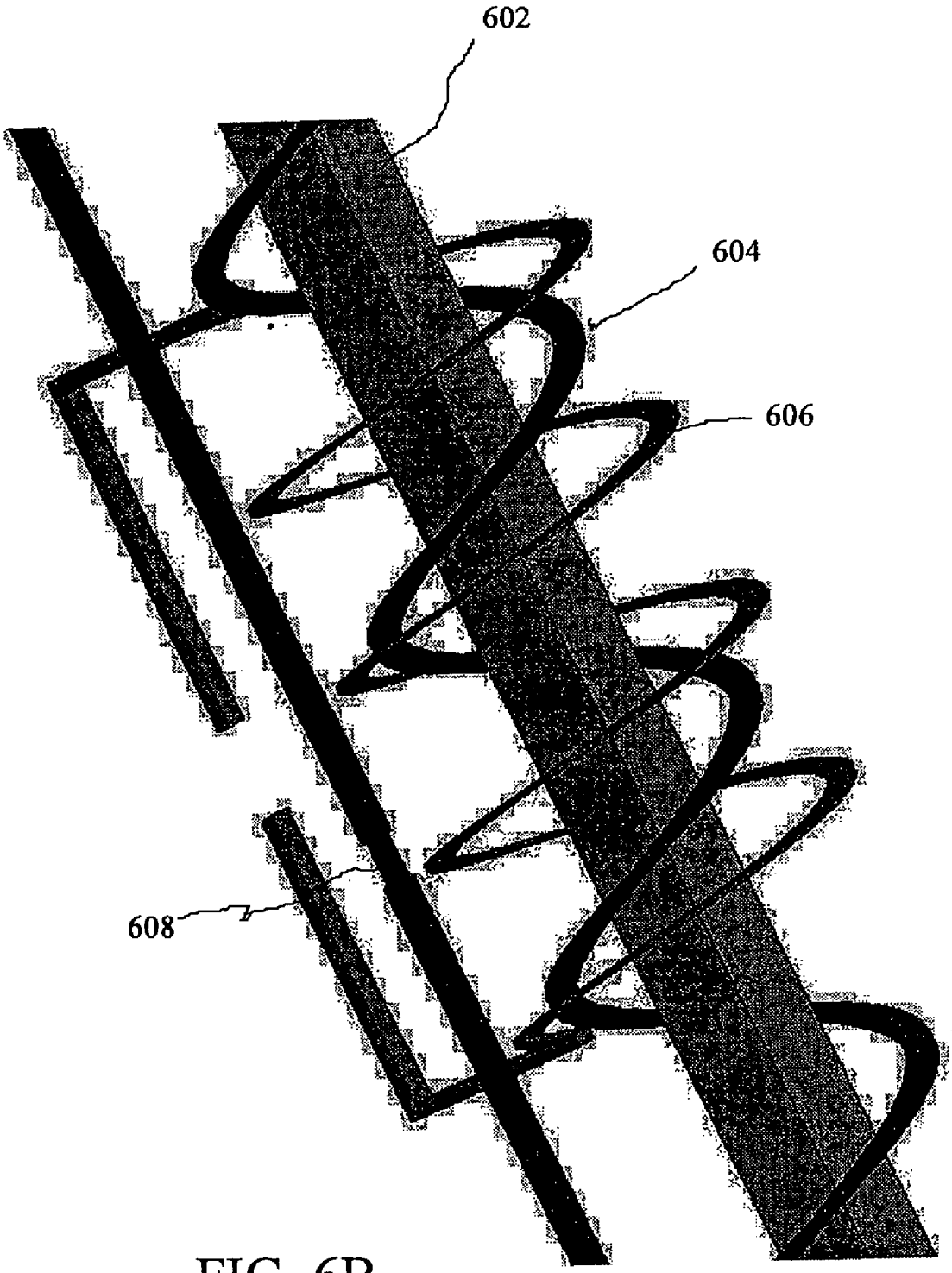
FIG. 6B is an perspective view of a portion of the antenna of FIG. 6A showing the primary and secondary windings in greater detail

FIGS. 6A and 6B are perspective views of another exemplary nanocrystalline magnetic core antenna 600 consistent with the invention. As shown, the core antenna 600 includes a nanocrystalline core assembly 602 with a primary resonant coil winding 604 and a secondary non-resonant coil winding 606. A capacitor 608, shown particularly in FIG. 6B, is coupled to the primary winding 604 for tuning the resonant frequency of the primary winding.

Providing multiple windings 604, 606 on a single core 602 allows use of the core to transmit at one frequency and receive at another frequency as long as sufficient frequency separation is provided. Using two windings operating at separate frequencies, such as 58 kHz and 13.56 MHz, also allows use of a single antenna as a transmitter and/or receiver at either frequency so that the antenna assembly can be plugged into a system operating at either frequency without special tuning. Additionally, multiple windings may be used such that the transmitter winding is tuned to 13.56 MHz and the receiver winding is tuned to 6.78 MHz (half-frequency) to facilitate operation using a frequency division scheme.

Figure 7:
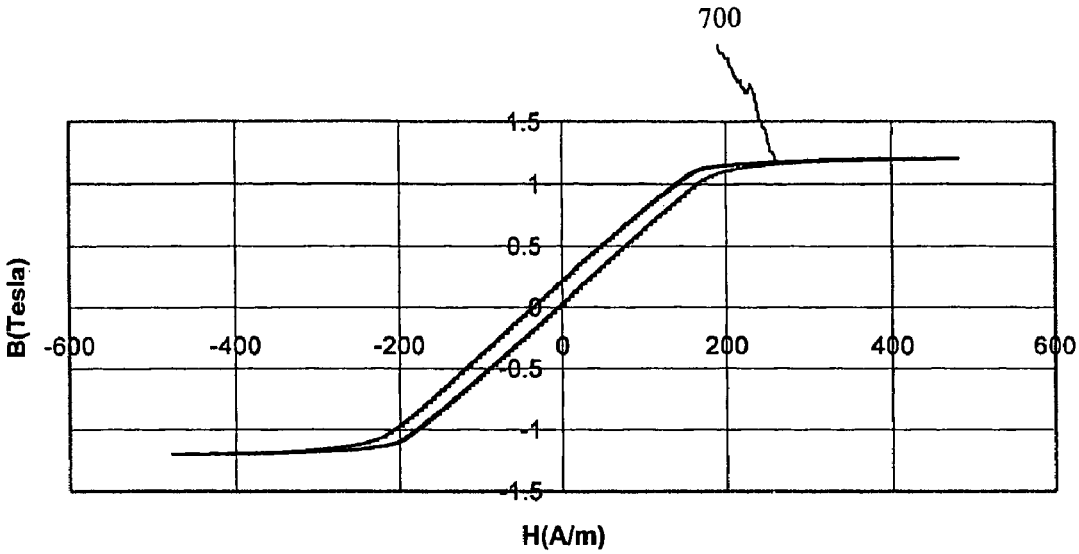
FIG. 7 is a plot of magnetic flux density versus magnetic field intensity for an exemplary nanocrystalline core antenna consistent with the invention.

Turning to FIG. 7, there is provided a BH plot 700 for an exemplary nanocrystalline magnetic core antenna consistent with the invention constructed as shown in FIG. 4 using a FINEMET core. The exemplary nanocrystalline magnetic core antenna was 60 cm long by 0.5 cm wide, by 0.5 cm high and operated at 1 KHz. In general, the plot includes a linear region at fields below saturation (H fields between about +/−170 A/m) and a flat region at saturation (H fields above and below about +/−250 A/m). The slope of the linear region determines the permeability. In general, a higher permeability results in a more sensitive antenna when configured to act as a receiver antenna.

Figure 8:
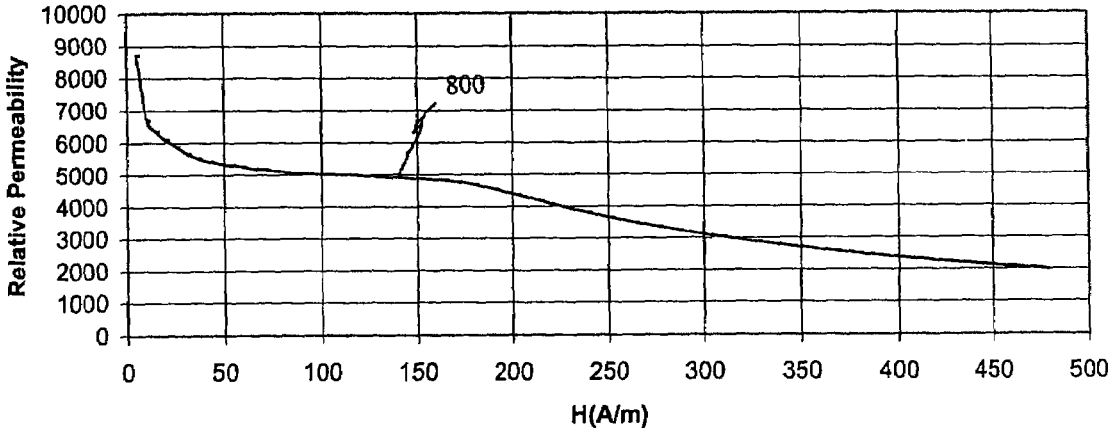
FIG. 8 is a plot of relative permeability versus magnetic field intensity for an exemplary nanocrystalline core antenna consistent with the invention.

FIG. 8 is a plot 800 of relative permeability versus H-field in Aim at a frequency of 1 kHz for the same exemplary 60 cm×0.5 cm×0.5 cm nanocrystalline magnetic core antenna exhibiting the BH plot of FIG. 7. As indicated, the relative permeability is about 5000 or higher at H fields between 0 and about 100 A/m. The permeability decreases relatively linearly until saturation at about 250 A/m where it begins to drop off even further. Of course, as the antenna operating frequency increases, permeability decreases. Nonetheless, high permeability is maintained compared to conventional core antenna configurations. For example, the same exemplary 60 cm×0.5 cm×0.5 cm nanocrystalline magnetic core antenna exhibiting the BH plot of FIG. 7 and permeability characteristic of FIG. 8 and operated at frequencies from 8.2 to 13.56 MHz exhibits a minimum relative permeability of 300. Due to the relatively high permeability and saturation level of nanocrystalline material, as indicated, for example, in FIGS. 7 and 8, a nanocrystalline core antenna used as a receiver antenna exhibits increased detection performance compared to conventional core antenna configurations.

Figure 9A:
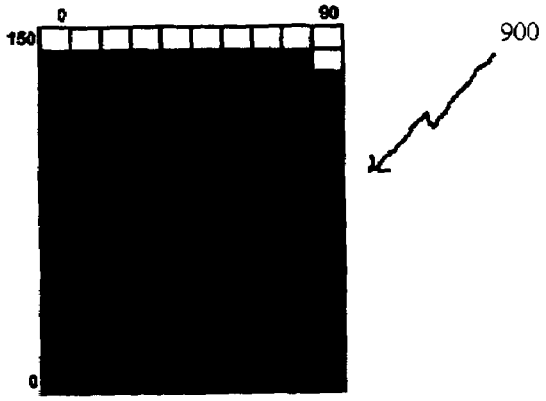
FIGS. 9A–9C are detection performance plots illustrating detection range for an EAS tag in lateral, horizontal, and vertical orientations, respectively, in an exemplary system consistent with the invention.
Figure 9B:
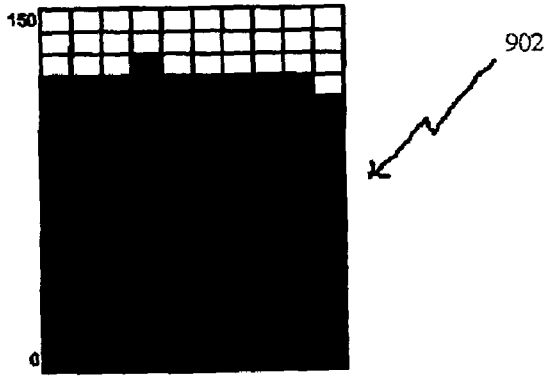
Figure 9C:
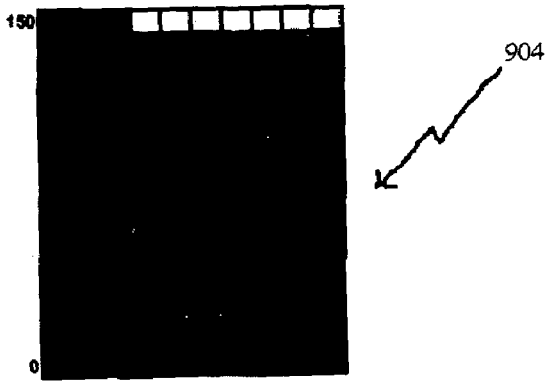

FIGS. 9A–9C are detection performance plots 900, 902, 904 illustrating detection range for an EAS tag in lateral, horizontal, and vertical orientations, respectively, associated with an axially arranged pair of nanocrystalline magnetic core antennas consistent with the invention. The two nanocrystalline magnetic core antennas were 60 cm long×0.5 cm wide×0.5 cm thick and provided in a 58 kHz detection configuration. The dimensions of the plots in each of FIGS. 9A–9C correspond to the height and width dimensions of the tested area. The shaded area of each figure shows detection of an EAS tag. Non-shaded areas are areas in which an EAS tag is not detected. As shown, the exemplary antenna configuration exhibits a detection range between about 0 cm and 90 cm over a large height range from about 0 cm to 150 cm. In addition, the detection rate, also referred to as the pick rate, for the lateral orientation was 93.1%. The pick rate for the horizontal orientation was 79.3%, and the pick rate for the vertical orientation was 95.6%. The exhibited detection range and pick rates compare favorably with those of amorphous core antennas.

There is thus provided a nanocrystalline core antenna for use in EAS and RFID systems. The nanocrystalline antenna is constructed from nanocrystalline material and exhibits excellent performance characteristics at RF frequencies. The performance of the antenna results in improved detection range in EAS and RFID systems compared to conventional antenna configurations.

The embodiments that have been described herein, however, are but some of the several which utilize this invention and are set forth here by way of illustration but not of limitation. It is obvious that many other embodiments, which will be readily apparent to those skilled in the art, may be made without departing materially from the spirit and scope of the invention as defined in the appended claims.

What is claimed is:

1. An EAS or RFID system comprising:

an antenna comprising a core and at least one coil winding disposed around at least a portion of said core, said core comprising nanocrystalline magnetic material;

a controller coupled to said at least one coil winding to provide an excitation signal to said winding; and a transmission line having one end coupled to said controller and another end coupled to said winding.

2. The system of claim 1, wherein said core comprises a laminated core assembly comprising a plurality of nanocrystalline magnetic ribbons.

3. The system of claim 2, wherein said plurality of nanocrystalline magnetic ribbons are stacked to form a substantially elongated solid rectangular laminated core assembly.

4. The system of claim 2, wherein said laminated core assembly comprises an insulating material disposed between each of said nanocrystalline magnetic ribbons.

5. The system of claim 1, wherein a relative permeability of said core is greater than 5000 for associated H-field values from about 0 A/m to about 100 A/m when said excitation signal has a frequency of 1 kHz.

6. The system of claim 1, wherein a relative permeability of said core is greater than or equal to 300 when said excitation signal has a frequency of 13.56 MHz.

7. The system of claim 1, wherein a relative permeability of said core is greater than or equal to 300 when said excitation signal has a frequency from 8.2 MHz to 13.56 MHz.

8. The system of claim 1, wherein said core has a length in a range from 20 to 80 cm, and a cross-sectional area in a range from 0.02 to 1 $cm^2$.

9. The system of claim 8, wherein a relative permeability of said core is greater than 5000 for associated H-field values from about 0 A/m to about 100 A/m when said excitation signal has a frequency of 1 kHz.

10. The system of claim 8, wherein a relative permeability of said core is greater than or equal to 300 when said excitation signal has a frequency of 13.56 MHz.

11. The system of claim 8, wherein a relative permeability of said core is greater than or equal to 300 when said excitation signal has a frequency from 8.2 MHz to 13.56 MHz.

12. The system of claim 1, wherein said transmission line has a first impedance level and a signal generator in said controller has a second impedance level, wherein said first impedance level and said second impedance level are substantially equal.

13. The system of claim 1, said system comprising a plurality of said coil windings.

14. The system of claim 13, wherein a first one of said coil windings is inductively coupled to a second one of said coil windings.

15. The system of claim 13, wherein first and second ones of said coil windings are configured for operation at different associated frequencies.

16. The system of claim 15, wherein said first coil winding is configured for transmitting at a first frequency and said second coil winding is configured for receiving a response from an EAS or RFID tag at a second frequency different from said first frequency.

17. An EAS or RFID system comprising:

an antenna comprising a core and at least one coil winding disposed around at least a portion of said core, said core comprising nanocrystalline magnetic material;

a controller coupled to said at least one coil winding to provide an excitation signal to said winding, wherein said antenna is configured as a transceiver antenna to generate said electromagnetic field and to detect a marker within said electromagnetic field, and wherein said controller comprises:

a transmitter driver circuit configured to provide said excitation signal;

a receiver circuit configured to receive said characteristic response signal from said marker, and a switch configured to switch said first coil winding of wire coil between said transmitter driver circuit and said receiver circuit.

18. The system of claim 1, wherein said excitation signal has a frequency in a range from 9 KHz to 300 MHz.

19. The system of claim 1, wherein said nanocrystalline magnetic material comprises grains having a maximum dimension in a range from 10 nm to 40 nm.

20. The system of claim 1, wherein said nanocrystalline magnetic material is an alloy comprising FeCuNbSiB.

21. The system of claim 1, wherein said nanocrystalline magnetic material is an alloy comprising FeZrNbCu.

22. The system of claim 1, wherein said nanocrystalline magnetic material is an alloy comprising FeCoZrBCu.

23. An antenna for use in an EAS or RFID system, said antenna comprising:

a core comprising nanocrystalline magnetic material and a plurality of discrete coil windings disposed around at least a portion of said core.

wherein a relative permeability of said core is greater than 5000 for associated H-field values from about 0 A/m to about 100 A/m when excited at a frequency of 1 kHz.

24. The antenna of claim 23, wherein said core comprises a laminated core assembly comprising a plurality of nanocrystalline magnetic ribbons.

25. The antenna of claim 24, wherein said plurality of nanocrystalline magnetic ribbons are stacked to form a substantially elongated solid rectangular laminated core assembly.

26. The antenna of claim 24, wherein said laminated core assembly comprises an insulating material disposed between each of said nanocrystalline magnetic ribbons.

27. The antenna of claim 23, wherein a relative permeability of said core is greater than or equal to 300 when excited at a frequency of 13.56 MHz.

28. The antenna of claim 23, wherein a relative permeability of said core is greater than or equal to 300 when excited at a frequency from 8.2 MHz to 13.56 MHz.

29. The antenna of claim 23, wherein said core has a length in a range from 20 to 80 cm, and a cross-sectional area in a range from 0.02 to 1 $cm^2$.

30. The antenna of claim 29, wherein a relative permeability of said core is greater than 5000 for associated H-field values from about 0 A/m to about 100 A/m when excited at a frequency of 1 kHz.

31. The antenna of claim 29, wherein a relative permeability of said core is greater than or equal to 300 when excited at a frequency of 13.56 MHz.

32. The antenna of claim 29, wherein a relative permeability of said core is greater than or equal to 300 when excited at a frequency from 8.2 MHz to 13.56 MHz.

33. The antenna of claim 23, wherein a first one of said plurality of discrete coil windings is inductively coupled to a second one of said plurality of discrete coil windings.

34. The antenna of claim 33, wherein said first and second ones of said plurality of coil windings are configured for operation at different associated frequencies.

35. The antenna of claim 34, wherein said first coil winding is configured for transmitting at a first frequency and said second coil winding is configured for receiving a response from an EAS or RFID tag at a second frequency different from said first frequency.

36. The antenna of claim 23, wherein said nanocrystalline magnetic material comprises grains having a maximum dimension of in a range from 10 nm to 40 nm.

37. The antenna of claim 23, wherein said nanocrystalline magnetic material is an alloy comprising FeCuNbSiB.

38. The antenna of claim 23, wherein said nanocrystalline magnetic material is an alloy comprising FeZrNbCu.

39. The antenna of claim 23, wherein said nanocrystalline magnetic material is an alloy comprising FeCoZrBCu.

40. A method of establishing an interrogation zone in an EAS or RFID system, said method comprising:

providing a nanocrystalline core antenna comprising a core and a plurality of discrete coil windings disposed around at least a portion of said core, said core comprising nanocrystalline magnetic material; and exciting at least one of the plurality of discrete coil windings with an excitation signal. wherein a relative permeability of said core is greater than 5000 for associated H-field values from about 0 A/m to about 100 A/m when said excitation signal has a frequency of 1 kHz.

41. The method of claim 40, wherein said core comprises a laminated core assembly comprising a plurality of nanocrystalline magnetic ribbons.

42. The method of claim 41, wherein said plurality of nanocrystalline magnetic ribbons are stacked to form a substantially elongated solid rectangular laminated core assembly.

43. The method of claim 41, wherein said laminated core assembly comprises an insulating material disposed between each of said nanocrystalline magnetic ribbons.

44. The method of claim 40, wherein a relative permeability of said core is greater than or equal to 300 when said excitation signal has a frequency of 13.56 MHz.

45. The method of claim 40, wherein a relative permeability of said core is greater than or equal to 300 when said excitation signal has a frequency from 8.2 MHz to 13.56 MHz.

46. The method of claim 40, wherein said core has a length in a range from 20 to 80 cm and a cross-sectional area in a range from 0.02 to 1 $cm^2$.

47. The method of claim 46, wherein a relative permeability of said core is greater than 5000 for associated H-field values from about 0 A/m to about 100 A/m when said excitation signal has a frequency of 1 kHz.

48. The method of claim 46, wherein a relative permeability of said core is greater than or equal to 300 when said excitation signal has a frequency of 13.56 MHz.

49. The method of claim 46, wherein a relative permeability of said core is greater than or equal to 300 when said excitation signal has a frequency from 8.2 MHz to 13.56 MHz.

50. The method of claim 40, wherein a first one of said plurality of discrete coil windings is inductively coupled to a second one of said plurality of discrete coil windings.

51. The method of claim 50, wherein said first and second ones of said plurality of discrete coil windings are configured for operation at different associated frequencies.

52. The method of claim 51, wherein said first coil winding is configured for transmitting at a first frequency and said second coil winding is configured for receiving a response from an EAS or RFID tag at a second frequency different from said first frequency.

53. The method of claim 40, wherein said excitation signal has a frequency in a range from 9 KHz to 300 MHz.

54. The method of claim 40, wherein said nanocrystalline magnetic material comprises grains having a maximum dimension of in a range from 10 nm to 40 nm.

55. The method of claim 40 ,wherein said nanocrystalline magnetic material is an alloy comprising FeCuNbSiB.

56. The method of claim 40, wherein said nanocrystalline magnetic material is an alloy comprising FeZrNbCu.

57. The method of claim 40, wherein said nanocrystalline magnetic material is an alloy comprising FeCoZrBCu.

* * * * *